United States Patent [19]

Bataille

[11] Patent Number: 4,846,492

[45] Date of Patent: Jul. 11, 1989

[54] SKI EQUIPMENT

[75] Inventor: Jean Bataille, Paris, France

[73] Assignee: Bataille Industrie, S.A., Paris, France

[21] Appl. No.: 216,107

[22] Filed: Jul. 7, 1988

[51] Int. Cl.[4] ..... A63C 9/08

[52] U.S. Cl. ..... 280/613; 36/120; 280/618; 280/631

[58] Field of Search ..... 280/613, 611, 616, 617, 280/618, 623, 627, 634, 631; 36/120

[56] References Cited

U.S. PATENT DOCUMENTS 3,992,037 11/1976 Frechin ..... 280/613
4,178,013 12/1979 Bataille ..... 280/618
4,284,292 8/1981 Faulin ..... 280/613

FOREIGN PATENT DOCUMENTS 0613867 10/1979 Switzerland ..... 280/618

*Primary Examiner*—David M. Mitchell
*Attorney, Agent, or Firm*—Helfgott & Karas

[57] ABSTRACT

The invention relates to ski equipment comprising a boot (1), an interface (2) and a ski (3). The boot (1) is a flexible-soled boot (4) provided at the front (9) and at the rear (18) with members (13, 19) for engagement with the interface (2). The interface (2) comprises a front part (7), a rear part (16) and a member (25, 26, 27) for clamping the boot (1) to the interface (2). Interface-operating means connects active binding members on the interface to passive binding elements on the ski.

9 Claims, 3 Drawing Sheets

SKI EQUIPMENT

The present invention relates to a ski equipment, that is a means for fixing skis to a skier's feet whilst still enabling his boots to be used for walking comfortably.

More precisely, the present invention proposes the creation of ski equipment which enables skis to be fixed to a skier's feet with various intermediate means, so that usual ski boots are not necessary, but flexible boots can be used, which facilitate walking and generally have excellent characteristics of comfort when the boot is fixed to the ski, as well as when it is detached, whilst enabling the skies to be fitted easily to the skier's feet.

By virtue of this equipment, a flexible-soled boot can be fixed to the ski without detracting from the ease with which the boot can be fitted to the ski, or from the ability to direct the ski with the foot, even in extreme conditions, whilst ensuring the same safety for the skier as with conventional skis and bindings.

Further advantages of the invention are the subject of the claims.

The invention will appear more clearly in the description of the drawings.

Figure 1:
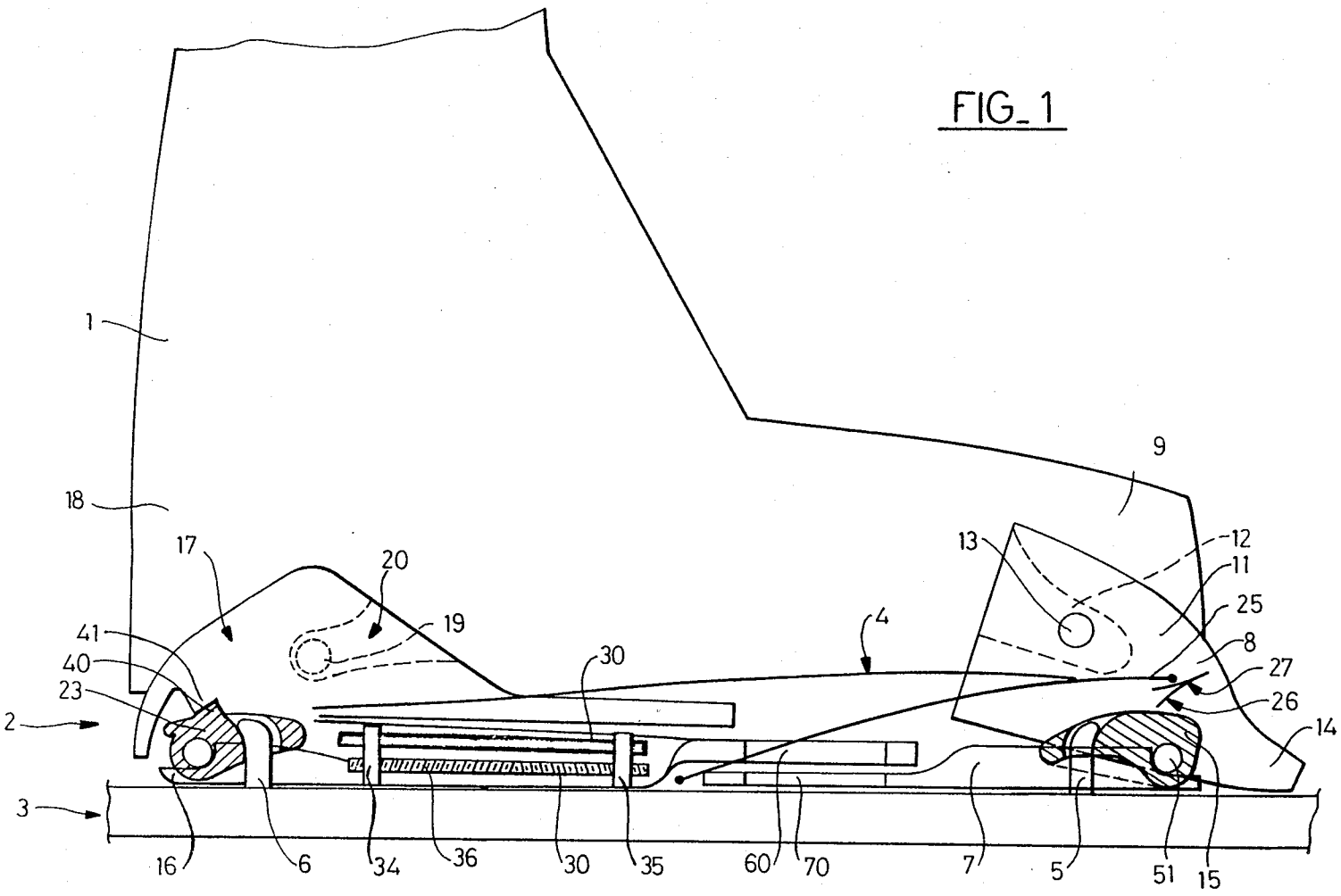
FIG. 1 represents the whole ski equipment.

With reference to the drawings, the invention relates to ski equipment including a boot 1, an interface 2 and a ski 3.

The boot 1 is a flexible-soled boot, that is, it is at least articulated level with the joint 4 of the foot.

The ski 3 includes a front passive hook-shaped binding member 5, fixed to the ski with its tip facing forward, as well as a back passive binding member 6 similar or identical in shape to the front passive member 5, but with its tip facing the back of the ski.

In the following description, the terms "front" and "rear" corresponding to the orientation of the ski and of the boot.

The interface 2 includes a front part 7 carrying a toe piece 8, that is to say a receptacle or member for housing the front part 9 of the boot 1. According to FIG. 5 this toe piece 8 is composed of a base 10 which houses the sole of the boot 1 and rising side walls 11. The side walls 11 include front engagement means 12 on their inner faces, constituted by guide tracks which are widened at their entrance to receive engagement members, for example in the form of studs 13 on the front of the boot 1. The front end 9 of the boot 1 is thus located in the toe piece 8. It should be noted that the toe piece 8 has a front end 14 which serves to locate the boot fitted with the interface against an abutment, not shown, on the ski 3 after the ski has been released.

The front part 7 also carries front active binding means 15 which are intended to cooperate with the passive binding means 5 of the ski. The binding means 15 are provided with biassing means described below. The binding means 15 are movable between a working position shown in FIG. 1 and a rest position; they are forced into the working position when the interface 2 is fitted to the ski 3 in the event of the ski having been released or when the interface 2 has been removed from the ski 3, the binding means 15 automatically come to the rest position under the effect of the biassing element.

The interface also includes a rear part 16 which, like the front part 7 is fitted on top of the ski. This rear part 16 is provided, like the front part 7, with notches or holes which enable passage of the front and rear binding members 5 and 6.

The rear part 16 carries a heel piece 17 which houses the rear part 18 of the boot 1 which is provided with engagement members 19 also in the form of two lateral studs. The heel piece 17 includes rear engagement means 20 in the form of guide tracks similar to the front engagement means 12 described above.

In fact, the heel piece 17 is composed of a base plate 21, on which the sole of the boot bears, as well as two side cheeks 22 which retain the boot 1 transversely; the two cheeks 22 are provided with rear engagement means 20 described below.

Figure 2:
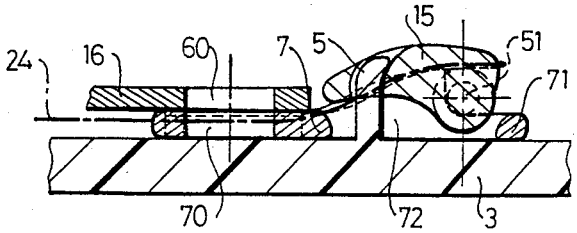
FIGS. 2 and 3 are detailled view of a part of FIG. 1.
Figure 3:
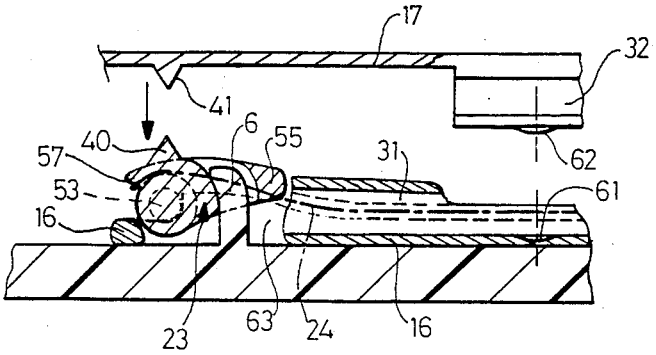
Figure 4:
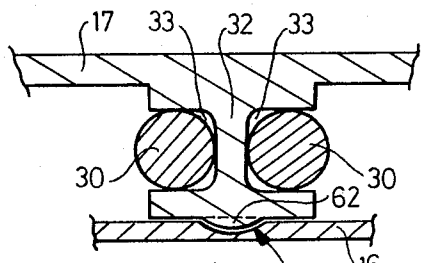
FIG. 4 shows the mounting of the flexion bars.

The rear part 16 also includes rear active binding means 23 for cooperating with the rear passive binding means 6 of the ski 3. The binding means 23 (FIG. 3) like the front binding means 15, (FIG. 2) are provided with a biassing element 24, and its structure and operation are essentially similar. The binding means 23 are movable between a working position, as shown in FIG. 3 and a rest position.

The interface 2 also includes means for clamping the boot 1 to the interface 2. In the embodiment shown, the clamping means are constituted by a plate spring 25 or by a U-shaped bracket fixed by one of its arms to pivot under the back part 16. In its normal position, the clamping means 25 work like a flexion spring and are situated above the toe piece 8. The plate spring cooperates with a retractable element 26 which engages it in its lowered position in which the toe piece 8 is clamped against the boot 1. In order to release it, it is only necessary to act deliberately on the tongue 27 of the element 26, to retract the latter and release the clamping element 25 as a result of its resilience, to enable the skier to remove the boot 1 from the interface 2, the interface itself remaining fixed to the ski 3.

Figure 8:
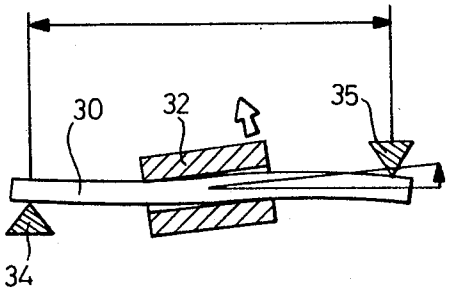
FIGS. 7 and 8 shows schematically the mechanics of the flexion bars.

According to the drawings, the interface also includes releasing means constituted by two parallel flexion bars 30, the ends of which are anchored in a housing 31 which corresponds with the back part 16. The heel piece 17 is provided on its lower face with a cam 32 which is positioned between the two flexion bars 30 by means of housings 33 which partially fit the sections of the flexion bars 30. The heel piece 17 can thus pivot transversely (FIG. 7) and from front to back or vice versa (FIG. 8). In order to effect this movement, a corresponding effort must be exerted on the heel piece 17 to deform the flexion bars 30.

The stiffness of the flexion bars 30 is adjusted by displacement (towards each other or apart) of their supports 34 and 35 which are preferably symmetrical relative to the cam 32; displacement is effected for example by means of a threaded rod 36 with inverse threadings fixed to a knurled wheel. (non shown).

The operating means also include a cam and counter-cam connection 40, 41; the cam 40 being carried by the rear active binding means 23, whilst the counter-cam 41 is carried by the lower face of the heel piece 17. The cam 40 and the counter-cam 41 are aligned, that is, they have little width transverse the interface 2 and when the heel piece 17 is aligned on the back part 16, the cam 40 and counter-cam 41 are situated one above the other or one behind the other, as will be explained in more detail below. It should be noted that the cam 40 and the counter-cam 41 cooperate with each other when the interface 2 is fitted to the ski 3 (the interface 2 itself being carried by the boot 1). At this moment the counter-cam 41 of the heel piece 17 acts on the cam 40 by virtue of the downward movement of the interface 2, and causes the rear active member 23 to pivot and prestress the resilient element 24 beyond the prestressing which would be achieved by the movement of fitting the interface 2 on to the passive members 5 and 6 of the ski 3 alone.

A relative thrust exerted between the ski 3 and the boot 1, which results in a relative sideways, forwards, or backwards pivoting movement, or a combined movement, between the heel piece 17 and the rear part 16, causes the counter-cam 41 to release the cam 40 enabling the rear binding means 23 to pivot as a result of the biassing force exerted by the biassing element 24. This pivoting releases the prestress exerted on the biassing element 24 and enables the rear binding means 23 to be released from the corresponding passive member 6 or even the front binding means 15 to be released from the front passive member 5.

Figure 5:
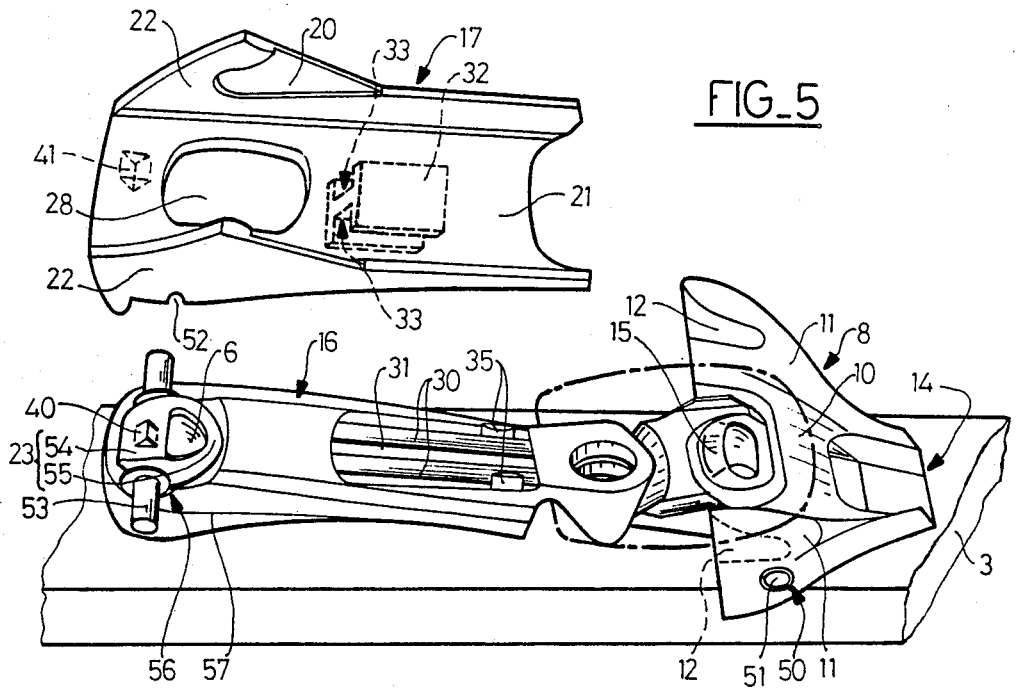
FIG. 5 represents a part of FIG. 1.

More precisely, as can be seen from FIG. 5, the heel piece 17 is composed of a base 21 bordered on each side by a lateral wall 27 for holding the boot 1. Level with the heel, this side wall becomes two cheeks 22 provided with engagement means 20.

The base 21 of the heel piece 17 is provided with a cut-out 28 for enabling free movement of the rear active binding means 23.

The drawing also shows the cam 32 represented by broken lines.

Finally, the rear edge of the heel piece 17 extends downwardly to cooperate with the rear part 16 and at the same time provides a guide and a forward abutment.

According to FIG. 5, the toe piece 8 is composed of a lower or transverse part 10, on which the front part of the sole of the boot 1 bears. This transverse part 10 is bordered on each side by a raised cheek 11 which serves to retain the boot 1 laterally. Each of the cheeks 11 is provided on its inner face, facing towards the boot, with front engagement means 12 in the shape of a guide track.

The toe piece 8 is provided with two holes 50 for passage of the axle 51 of the front active binding means. Heel piece 17 simply has a slight groove or shoulder, 52 which is placed on the axle 53 of the rear active binding means 23.

The member 23 is essentially identical to the front binding member 15 but with the difference that the rear binding member 23 carries the cam 40, whereas there is no cam on the front binding member 15.

The rear binding member 23 is constituted by a body 54 which is extended on both sides by an axle 53. The body 54 carries a ring 55. The binding member 23 can pivot in lateral bearings 52 and 56 defined on one side (52) by the heel piece 17 and on the other side (56) by the rear part 16, by virtue of opposing forces exerted on the one hand by the biassing element 24 constituted by a loop of cable passing over an abutment 57 of the body 54 (FIG. 3) of the binding member 23, and on the other hand by the downward effort exerted by the skier when he places the interface 2 on the ski 3.

The active binding member 23 is intended to fit over the corresponding passive binding member 6 of the ski. For this purpose, according to the invention, when it is in the rest position, that is when the biassing element 24 is not stressed or is only slightly stressed, the ring 55 is directed downwardly (relative to the heel piece 17 and the lower part 16) and projects from the lower surface of the rear part 16. The ring 55 first of all meets the passive member 6 of the ski 3 and by virtue of the downward force exerted by the skier, the ring 55 makes the active member 23 pivot so that it "rolls" along an involute path over the passive member 6 to enable the body 54 of the active binding member 23 to pass under the tip 6A of the passive binding member 6.

The rear part 16 is a part having a relatively complicated shape, of which the front end, situated essentially in the middle of the boot, level with the joint of the foot, has a connecting eyelet 60. Behind this eyelet 60, the rear part 16 includes the housing 31 for releasably housing the flexion bars 30. The base of the essentially rectangular-shaped housing has a recess 61 for cooperating with a ball-shaped part 62 provided on the cam 32 of the heel piece 17. At its left-hand end with reference to FIG. 3, the rear part 16 includes a slot 63 for passage of the passive member 6 as well as for housing the active binding member 23. The bearing 56, which is simply sketched, is bordered at the front by the cheeks 57 of the part 16 to retain the active binding member 23 against the forces exerted by the biassing element 24.

Similarly, the front part 7 is composed of an eyelet-shaped end 70 which is intended to be housed under the eyelet 60 of the rear part 16 to form the articulation of the interface. This articulation can be achieved by a block, not shown, of rubber or of other flexible material passing through the two eyelets 60 and 70 and connecting them.

Towards the right, the front part 7 has a loop 71 which defines the housing 72 in which the front active binding member 15 is placed.

In simple terms, the front part 7 corresponds to the back part 16 without the section which serves as the housing 31 for the flexion bars 30.

The front part 7 also has a bearing not shown which forms an abutment in the direction of the tension to receive the corresponding axle 51 of the active binding member 15 once the axle has been introduced into the holes 50 in the toe piece 8; in this case, the toe piece 8 and the active binding member 15 constitute an articulated but connected assembly.

The interface assembly 2 described above may to advantage be enclosed in a film of flexible synthetic material which keeps it watertight and protected against sand, dirt, etc.

Figure 6:
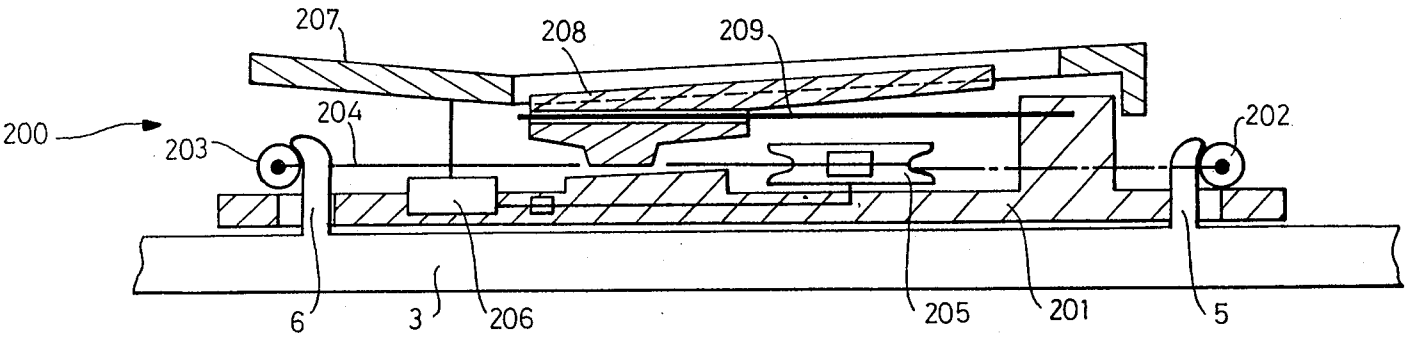
FIG. 6 shows an other ski equipment according to the invention

FIG. 6 illustrates partially a variant of the invention showing only the ski 300 and the interface 200 which ensures connection to the ski. The rear part and the front part of the interface 200 have been represented by a single part 201, (their articulation has not been drawn, but may nevertheless exist).

The front and rear active binding members are constituted by bodies in the shape of rollers 202 and 203 through which a cable 204, common to the two rollers 202 and 203, passes. The cable 204 passes over a variable-diameter support 205, so as to enable the interface 200 to be fitted to the ski and to be released therefrom.

The support 205 is connected to an operating member 206 which is in turn connected to an intermediate member 207 connected to the heel piece, not shown. The intermediate member 207 carries a member 208 for adjusting the stiffness of a flexion member 209 (flexion bar) whose fixed end is anchored to the lower part 201. The adjustment member is biassed into its aligned position by the flexion bar. The intermediate member tends to be displaced relative to the lower plate as a result of forces exerted on the foot or on the ski. This displacement results in action on the operating means which cause variation of the radius of the pulley when the stress exceeds a predetermined threshold; this releases the tension in the cable passing through the active binding members and enables one or other thereof to be released from the passive binding members of the ski; the ski is thus released.

The description below concerns the operation of the ski equipment, that is the positioning of the various elements and their interconnection.

Fitting and release will be described, fitting, like release, including two stages.

FITTING

Hypothetically, the interface 2 is assumed to be in place on the ski 3. In this case, the toe piece 8 is pivoted forwards. The skier places the heel of his boot in the heel piece 17 until it comes into abutment at the end of its travel, and then lowers the front end of his boot into the toe piece 8 pushing down the flexion spring 25. During this downward movement, the engagement members 13 of the boot 1 slide into the front engagement means 12 of the interface 2 and make the toe piece 8 pivot whilst the spring plate 25 is pushed down until it is snap-engaged. The fitting, that is the introduction of the boot into the interface is thus completed.

For the second fitting operation, it is assumed that the ski has been released and that the interface 2 has, as envisaged, remained fixed to the boot 1. The skier then positions his foot, fitted with the interface 2, placing the front end 14 of the toe piece 8 against an abutment not shown, which is provided on the ski 3 and then engages the front active member 15 around the front passive member 5. This operation causes only slight tensioning of the resilient element 24 of the front active member; this resilient element is preferably in common with the resilient element of the rear active member 23. The skier then continues to pivot and lowers his heel to engage the rear active member 23 on the rear passive member 6 by rolling the rear active member and making it move back. This pivoting results in the tensioning of the biassing element 24. During this pivoting, the counter-cam 41 bears on the cam 40 of the active member 23 (since the heel piece 17 and the rear part 16 must be aligned) until the counter-cam 41 has passed over the cam 40 and the release control has been set.

The boot 1 fitted with the interface 2 is then firmly fixed to the ski 3.

RELEASE

Release may be intentional or accidental.

Generally, in the case of intentional release, the skier simply wishes to release his boot 1 from the interface 2, leaving the interface 2 on the ski 3. For this purpose, he operates the retractable element 27, for example with his ski stick, so as to release the flexion spring 25 so that the toe piece 8 is free to pivot, enabling the engagement member 4 of the boot 1 to be released from the corresponding engagement means 12 of the toe piece 8. Once the front end 9 of the boot 1 is released from the interface 2, he simply releases his heel 18 by taking the rear engagement members 19 of the boot 1 out of the rear engagement means 20.

According to the invention, accidental, that is safety release, takes place between the interface 2 and the ski 3, the interface 2 remaining fixed to the boot 1. Disengagement is effected by movement of the heel piece 17 relative to the rear part 16 or relative to the ski 3, the movement exceeding a certain torque set by the flexion bars 30. When this torque is exceeded, which means that the heel piece has moved relative to the back part 16 beyond the release threshold, the counter-cam 41 is positioned beside the cam 40 and the latter is free to move (torsion movement). In the case of a fall forwards, the counter-cam 41 is raised and thus enables the cam 40 to pass. In both cases, the cam 40 can pivot and enable the rear active member 23 to pivot about the rear passive member 6. This pivoting reduces the tension in the resilient element 24, or releases the tension. The rear active member 23 or the front active member 15 can then be released from the corresponding passive member 6 or 5. The interface 2 (remaining fixed to the boot) is then released from the ski 3.

It should be noted that the resilient envelope which completely encloses the interface, even at the level of the holes which receive the front and rear passive members, facilitates or reinforces the ejection effect.

Figure 7:
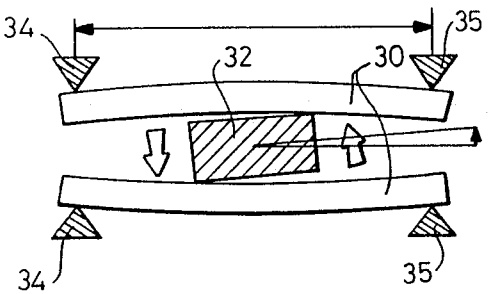

FIGS. 7 and 8 show schematically the mechanics of the flexion bars 30 for a torsion movement and for a fall forwards. It should be noted that the separation of the support points 34 and 35 of each flexion bar 30 is adjustable. Movement of these support points towards each other increases the stiffness of the flexion bars and thus corresponds to a higher releasing torque. Conversely, movement apart makes their movement more flexible and causes earlier release.

The same applies for flexion upon falling forwards, by movement towards each other or apart of the corresponding supports on the flexion bar or bars.

In effect, the explanations given above of the adjustment of the stiffness of the flexion bars apply in exactly the same way if there is only one flexion bar.

I claim:

1. Ski equipment comprising a boot, an interface and a ski, the boot being a flexible-soled boot provided at a front and at a rear thereof with members for engagement with the interface, the interface including:

a front part carrying a toe piece for housing the front part of the boot, provided with front engagement means for cooperating with the corresponding engagement members of the boot, front active binding means which cooperate with front passive binding means of the ski, the active binding means being provided with a biassing element and being movable between a working position and a rest position, and forced into the working position when the interface is fitted on to the ski, and returning automatically to the rest position when the interface is released from the ski, a rear part carrying a heel piece for housing the rear part of the boot, provided with rear engagement means which cooperate with the engagement members of the boot at a rear side thereof, rear active binding means cooperating with the passive binding means of the ski at a rear end thereof, the rear active binding means being provided with a biassing element which is movable between a working position and a rest position, and being forced into the working position when the interface is fitted on to the ski and returning automatically to the rest position when the interface is released from the ski, a clamping member for clamping the boot to the interface, interface-operating means constituted by a connection with at least one flexion bar for connecting the heel piece to the rear part, and a cam and counter-cam connection between the heel piece and the rear active binding means, the cam and the counter-cam cooperating with each other in aligned positions, when the rear part and the heel piece are aligned and thus prestressing the biassing element of the rear active binding means beyond the level of prestressing established by engagement of the rear active binding means with the corresponding passive binding means alone, whereas a movement of the heel piece relative to the rear part as a result of a force which exceeds the threshold, releases the cam from the rear active binding means which can pivot and reduce the prestressing of the biassing element, the ski including said passive binding members which receive the active binding members of the interface.

2. Ski equipment according to claim 1, wherein the interface is flexible, the front part and the rear part, being connected to each other by an articulation.

3. Ski equipment according to claim 1, wherein the clamping member is constituted by a flexion spring situated above the toe piece (8) and cooperating with a retractable element carried by the front part, the spring, which bears on the rear part being flattened and clamped by being depressed under the action of the foot as it bears on the rear part to keep the toe piece applied against the front part, the boot being released by deliberate release of the clamping member by the skier and the release of the spring itself releasing the toe piece.

4. Ski equipment according to claim 1, wherein each active binding member is constituted by a body provided with an axle and carrying a ring, the member pivoting in lateral bearings formed in the front part and the rear part, the biassing element being a loop of cable passing over a part of the body of the active binding member to bias the member into the rest position about its axis, each passive member of the ski being a hook facing towards the corresponding end of the ski and the ring of the binding member being fitted on to the hook under the pressure of the foot of the skier by effecting a pivoting movement around the hook causing tensioning of the biassing element.

5. Ski equipment according to claim 1, wherein the toe piece is constituted by a base defined by two lateral walls in which tracks are formed for the introduction and housing of the corresponding engagement members of the boot, these members being constituted by studs.

6. A ski component according to claim 4, wherein the biassing element is a single cable passing in a respective loop over the two active binding members.

7. A ski component according to claim 1, wherein the cam and the counter-cam are teeth provided on the rear active member and on the heel piece respectively.

8. Ski equipment according to claim 1, wherein the active binding members are rollers through which a common cable passes, which passes over a variable-diameter support constituting a resilient element.

9. Ski equipment according to claim 1, wherein a plurality of flexion bars are supported by supports a separation of which is adjustable.

* * * * *